US008210113B1

(12) United States Patent
Ellis

(10) Patent No.: US 8,210,113 B1
(45) Date of Patent: Jul. 3, 2012

(54) WEB CUTTING AND SEWING APPARATUS

(76) Inventor: Michael A. Ellis, Chickamauga, GA (US)

( * ) Notice: Subject to any disclaimer, the term of this patent is extended or adjusted under 35 U.S.C. 154(b) by 691 days.

(21) Appl. No.: 12/395,640

(22) Filed: Feb. 28, 2009

Related U.S. Application Data

(60) Provisional application No. 61/032,714, filed on Feb. 29, 2008.

(51) Int. Cl.
*D05B 23/00* (2006.01)

(52) U.S. Cl. ..... 112/470.12; 112/119

(58) Field of Classification Search ..... 112/117, 112/119, 217.1, 118, 470.12, 470.13, 470.33, 112/303–307, 475.07, 475.08
See application file for complete search history.

(56) References Cited

U.S. PATENT DOCUMENTS 3,960,095 A * 6/1976 Story ..... 112/118
4,192,241 A * 3/1980 Reed et al. ..... 112/117
5,913,277 A * 6/1999 Resta ..... 112/470.12
6,631,688 B1 * 10/2003 Maag ..... 112/118
6,792,884 B1 * 9/2004 Barrus ..... 112/475.08
6,951,178 B2 * 10/2005 Watts ..... 112/118
7,011,031 B1 * 3/2006 Bradley ..... 112/119

* cited by examiner

*Primary Examiner* — Larry Worrell, Jr.
(74) *Attorney, Agent, or Firm* — QuickPatents, Inc.; Kevin Prince

(57) ABSTRACT

A sewing system is disclosed for facilitating the sewing together with a sewing machine ends of at least two webs that are held by a spooling machine. A substantially horizontal carriage rail is supported by a support mounting means in fixed relationship with the spooling machine and itself slidably supports a sewing carriage adapted to hold the sewing machine. A trimming carriage is also slidably supported on the carriage rail and supports a conventional trimming machine that trims the ends of each web ahead of the sewing machine. The trimming carriage is selectively and mechanically fixed with the sewing carriage with a mechanical fastener, so that as the sewing carriage is moved along the carriage rail, the trimming carriage is also moved along thereby. A substantially horizontal support platform is fixed with the carriage rail and adapted to hold each web fixed with respect thereto with a plurality of vertically-movable pins that traverse each web in a raised position.

17 Claims, 6 Drawing Sheets

WEB CUTTING AND SEWING APPARATUS

CROSS-REFERENCE TO RELATED APPLICATIONS

This application claims the benefit of U.S. Provisional Patent Application 61/032,714, filed on Feb. 29, 2008, and incorporated herein by reference.

STATEMENT REGARDING FEDERALLY SPONSORED RESEARCH AND DEVELOPMENT

Not Applicable.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by any one of the patent disclosure as it appears in the Patent and Trademark Office patent files or records, but otherwise reserves all copyright and trade dress rights whatsoever.

FIELD OF THE INVENTION

This invention relates to web sewing machines, and more particularly to an improved sewing rail system for trimming and sewing webs of carpet.

DISCUSSION OF RELATED ART

The continuous industrial production of carpet or textile webs, including dying, printing, coating, drying, heat setting, curing, or otherwise conveying a tufted or woven fabric web of various widths, is a complex process that traditionally requires the use of both an unwind system and a separate sewing and trimming device. After coming off an unwind system, tufted and woven material such as carpet, turf, floor coverings, or textile webs are brought to a sewing and trimming area to be sewn and trimmed into a continuous web for subsequent continuous operations such as chemical application, dying, and the like The carpet or textile webs are typically in rolls or folded into flats when arriving at the area to be trimmed or sewn.

After the carpet or textile web comes off the unwind system, the carpet or textile web is trimmed (if necessary) and sewn on a separate sewing and trimming device. Current sewing and trimming devices are stand-alone systems that are bulky and occupy considerable space in front of the unwind system. Conventional sewing machines and trimming machines for such webs run on a horizontal plate that has a relatively large footprint, taking up valuable production floor space. Moreover, the current process requires that at least two operators remove the carpet or textile web from each end of the unwind system and manually transport the carpet or textile web to the trimming and sewing device. The carpet or textile web is then placed onto nails located on the trimming and sewing device to stabilize the piece for alignment before the trimming and sewing step. Such exposed nails present a safety hazard to the operators of such devices and frequent injury occurs as a result. Transporting the carpet or textile web from the unwind system to the sewing and trimming device is time-consuming and requires at least two operators.

Therefore, there is a need for a device that allows for trimming and sewing of such webs directly from the unwind system, without requiring a separately-located station. Such a needed device would make it possible for the unwind system to support the webs as a single operator positions the ends of the webs for trimming and sewing in the device. The nails that hold the webs in place, in such a needed system, would be automatically retractable to reduce the hazard operators of such equipment face when manipulating the webs in proximity to such nails. Further, such a needed invention would conveniently allow for the trimming machine to be used with and in advance of the sewing machine, or not, depending upon need, again with a single operator. The present invention would make it possible to trim and sew ends of such webs in less than a couple of minutes, with one operator, all more safely than with convention trimming and sewing operations. The present invention accomplishes these objectives.

SUMMARY OF THE INVENTION

The present device is a sewing system for facilitating the sewing together with a sewing machine ends of at least two webs that are held by a spooling machine, such as an unwind machine or other web handling apparatus. A substantially horizontal carriage rail is supported by a support mounting means in a substantially fixed relationship with the spooling machine such that an operator of the sewing system is within arm's reach of the webs of the spooling machine.

A sewing carriage is slidably supported on the carriage rail and adapted to hold the sewing machine thereon. The sewing machine is adapted to move the sewing carriage along the carriage rail under its own power, or the sewing carriage is moved along the carriage rail with a drive means that is manually actuated. An automatic sewing carriage return means may be included to return the sewing carriage from a distal end of the carriage rail to the proximal end.

A trimming carriage is also slidably supported on the carriage rail and supports a conventional trimming machine that trims the ends of each web ahead of the sewing machine. The trimming carriage is selectively and mechanically fixed with the sewing carriage with a mechanical fastener, so that as the sewing carriage is moved along the carriage rail, the trimming carriage is also moved along thereby.

A substantially horizontal support platform is fixed with the carriage rail and adapted to hold each web fixed with respect thereto, such that the sewing machine can sew the webs together as the sewing carriage is moved from the proximal end of the rail to the distal end thereof. Preferably the horizontal support platform is fixed to the rearward side of the carriage rail with a plurality of rigid risers. The support platform preferably further includes at least two sets of substantially vertical pins, each set of pins being selectively moveable with an actuator between an extended expanded position, an extended contracted position, and a lowered position below the horizontal support platform and out of the way of the operator. In the extended collapsed position, with each pin fixed through the webs, the actuator may be actuated to expand the distance between each set of pins, thereby fixing the webs tautly on the pins.

The present device allows for trimming and sewing of such webs directly from the unwind or spooling system, without requiring a separately-located station. The present invention makes it possible for the spooling machine to support the webs while a single operator positions the ends of the webs for trimming and sewing in the device. The nails that hold the webs in place, in such a device, are automatically retractable to increase safety. Further, present invention conveniently allows for the trimming machine to be used with and in advance of the sewing machine, or not, depending upon need, again with a single operator. The present device makes it possible to trim and sew ends of such webs in less than a couple of minutes, with one operator, all more safely than with convention trimming and sewing operations. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
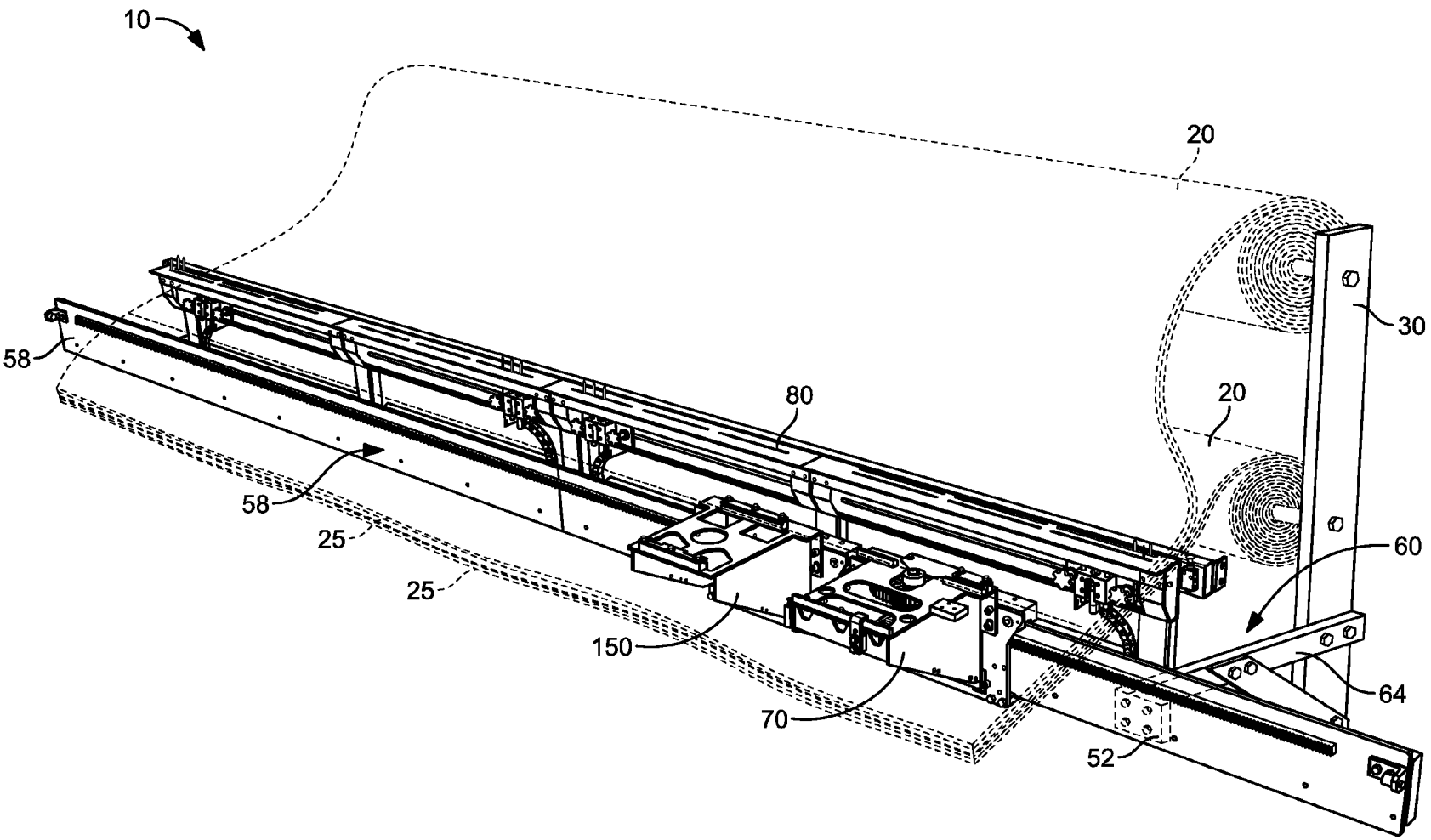
FIG. 1 is a perspective view of the invention, illustrating a carriage rail as supported on a spooling machine.
Figure 3:
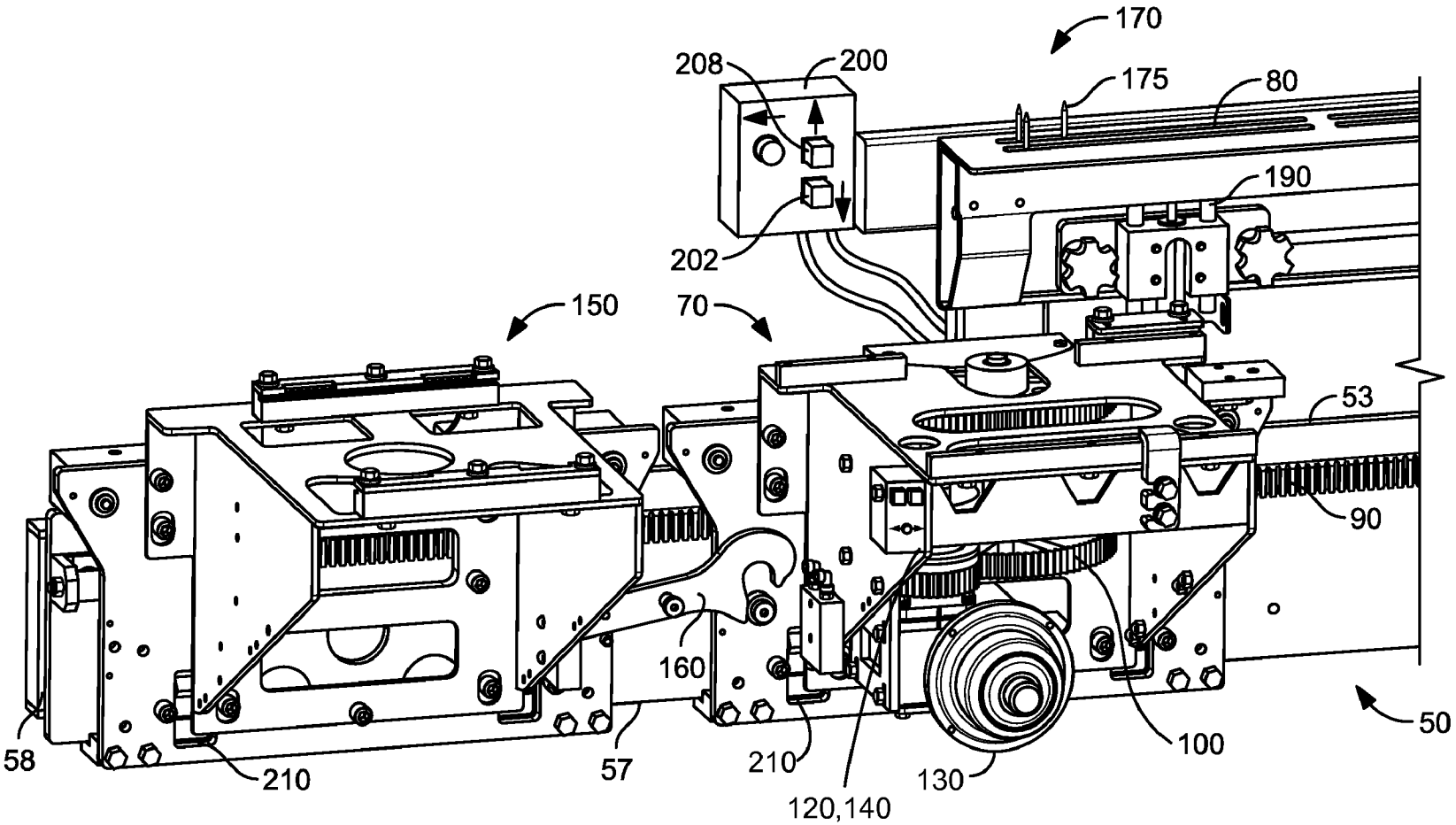
FIG. 3 is a partial perspective view of the invention, illustrating a sewing carriage and a trimming carriage of the invention.
Figure 4:
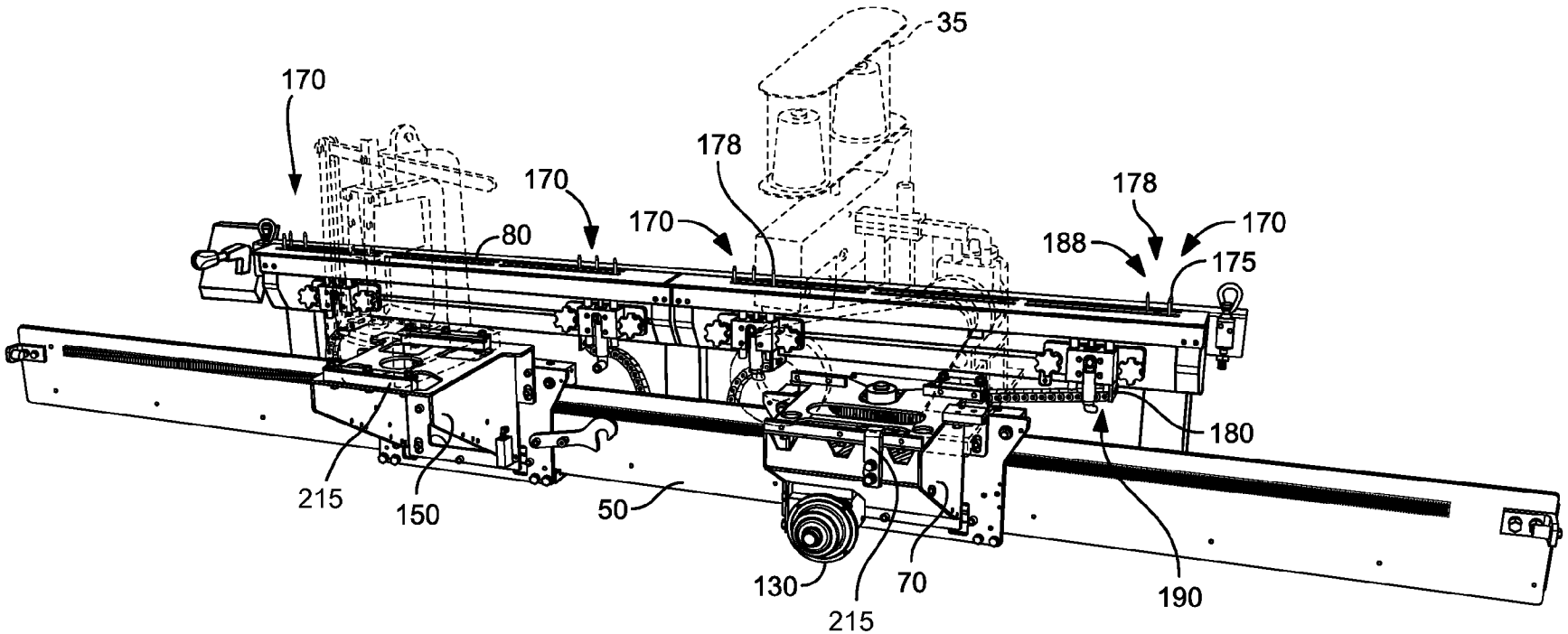
FIG. 4 is a perspective view of the invention, illustrating a sewing machine as fixed to the sewing carriage and a trimming machine as fixed to the trimming carriage.

FIGS. 1 and 3 illustrate a sewing system 10 for facilitating the sewing together with a sewing machine 35 (FIG. 4) ends 25 of at least two webs 20 that are held by a spooling machine 30, such as an unwind machine or other web handling apparatus.

A substantially horizontal carriage rail 50 has a proximal end 52, a distal end 58, a forward side 51, a rearward side 59, a top side 53 and a bottom side 57. The carriage rail 50 further includes a support mounting means 60 that is adapted to support the carriage rail 50 in a substantially fixed relationship with the spooling machine 30. Such a support mounting means 60 may be, for example, at least one floor stand 62 (FIG. 2) for supporting the sewing system 10 on a ground surface 15 proximate to the spooling machine 30. Alternately, the support mounting means 60 may be a rigid framework 64 (FIG. 1) for supporting the sewing system 10 directly on the spooling machine 30. Regardless, the sewing system 10 must be within and operator's arm's length or otherwise within easy reach of the ends 25 of each web 20. Preferably the carriage rail 50 is a vertically-oriented steel plate, as illustrated.

A sewing carriage 70 is slidably supported on the carriage rail 50 and adapted to hold the sewing machine 35 thereon. Such a sewing machine 35 may be, for example, model 48500 from Textile and Industrial Sales, Inc. (TISI) of Dalton, Ga. (www.trimsew.com). Alternately, the model 38500, also from TISI, may be used, or like machines from other suppliers. Preferably the sewing carriage further includes rollers 210 for supporting the sewing carriage 70 on the carriage rail 50. Further, the sewing carriage 70 may include mechanical clamps 215 (FIG. 7) for clamping the sewing machine 35 to the sewing carriage 70. The shape of the sewing carriage 70 is adapted to receive the lower side of the sewing machine 35, with apertures (not enumerated) to receive projections, wheels, and the like of the sewing machine 35.

Figure 2:
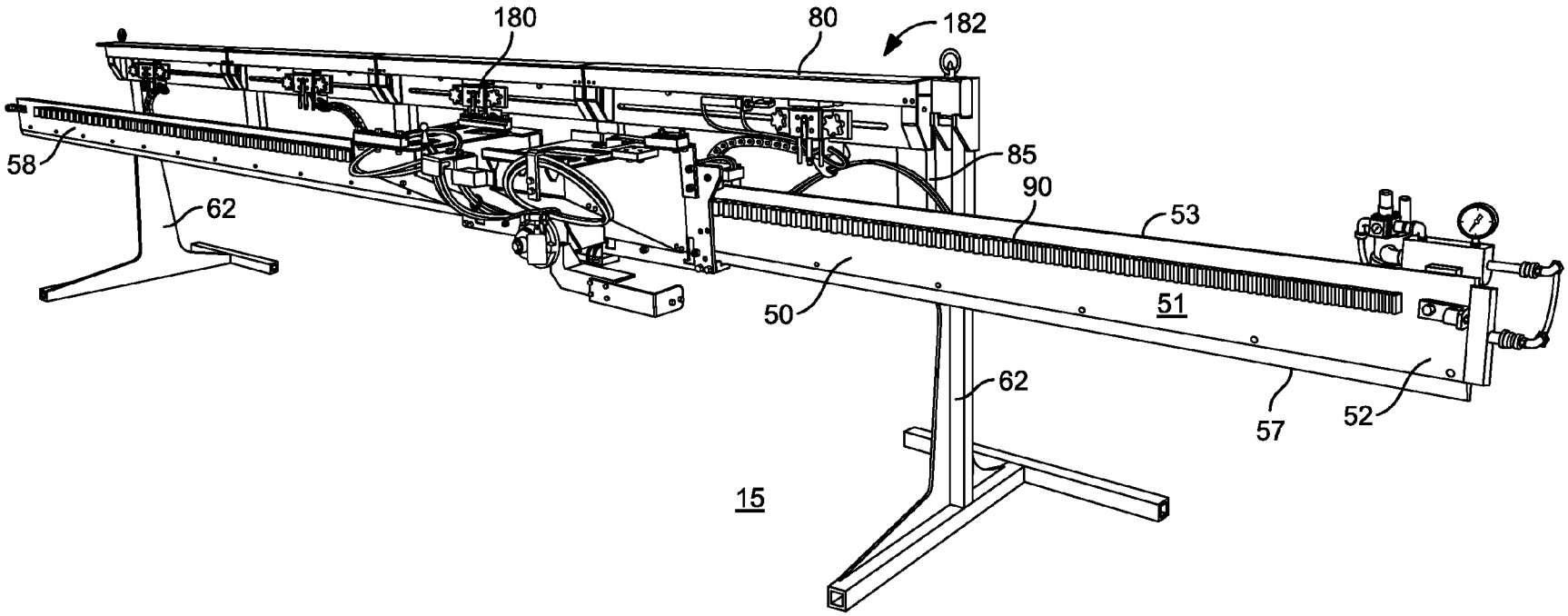
FIG. 2 is a perspective view of an alternate embodiment of the invention, illustrating the carriage rail as supported on a floor surface.

In one embodiment, the carriage rail 50 further includes a linear rack gear 90 fixed thereto that spans substantially the length of the carriage rail 50 from the distal end 58 to the proximal end 52 (FIG. 2). In such an embodiment, the sewing carriage 70 further includes a pinion gear 95 that engages the rack gear 90 when the sewing carriage 70 is supported on the carriage rail 50. As such, rotating the pinion gear 95 moves the sewing carriage 70 on the carriage rail 50. A drive means 100 is included on the sewing carriage 70 for selectively rotating the pinion gear 95 in either direction. Such a drive means 100 may be, for example, a longitudinal drive 26 of the sewing machine 35 (FIG. 4), or an electric motor 110 controlled by a switch 120 having a least a forward, reverse, and stop positions, or a pneumatic motor 130 controlled by an air valve 140 having at least forward, reverse, and stop positions.

Figure 5:
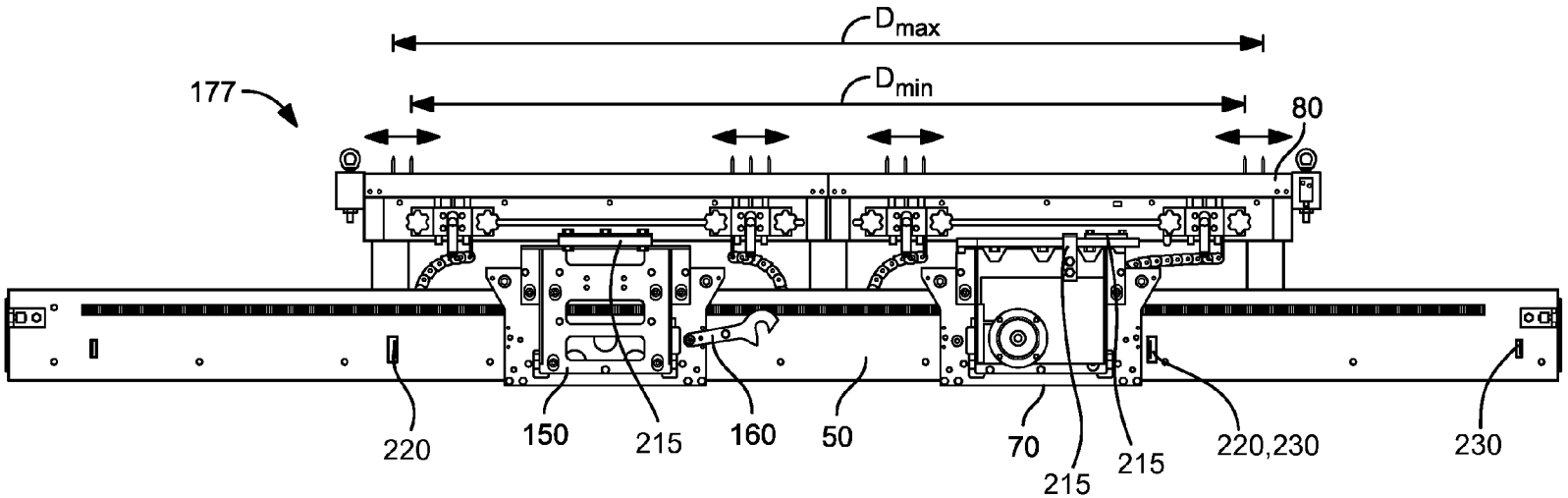
FIG. 5 is a front elevational view of the invention.
Figure 6:
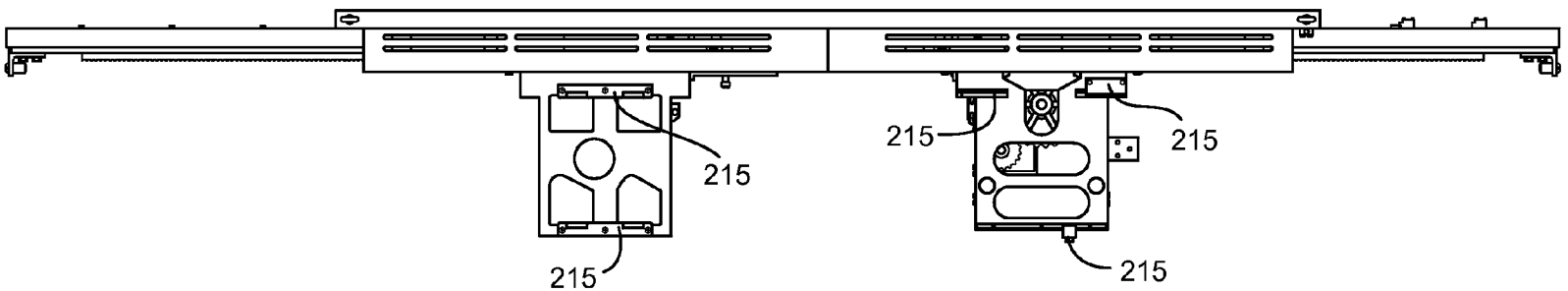
FIG. 6 is a top plan view of the invention.

Preferably, and as illustrated, the sewing system 10 further includes a trimming carriage 150 slidably supported on the carriage rail 50 that is adapted to support a conventional trimming machine 40 that trims the ends of each web 20 ahead of the sewing machine 35. The trimming carriage 150 is selectively and mechanically fixed with the sewing carriage 70 with a mechanical fastener 160, such as a hook (FIGS. 3 and 5). Preferably the trimming carriage 150 further includes the rollers 210 for supporting the trimming carriage 150 on the carriage rail 50. Further, the trimming carriage 150 may include mechanical clamps 215 (FIG. 7) for clamping the trimming machines 40 to the trimming carriage 150. The shape of the trimming carriage 150 is adapted to receive the lower side of the trimming machine 40, with apertures (not enumerated) to receive projections, wheels, and the like of the trimming machine 40.

Figure 7:
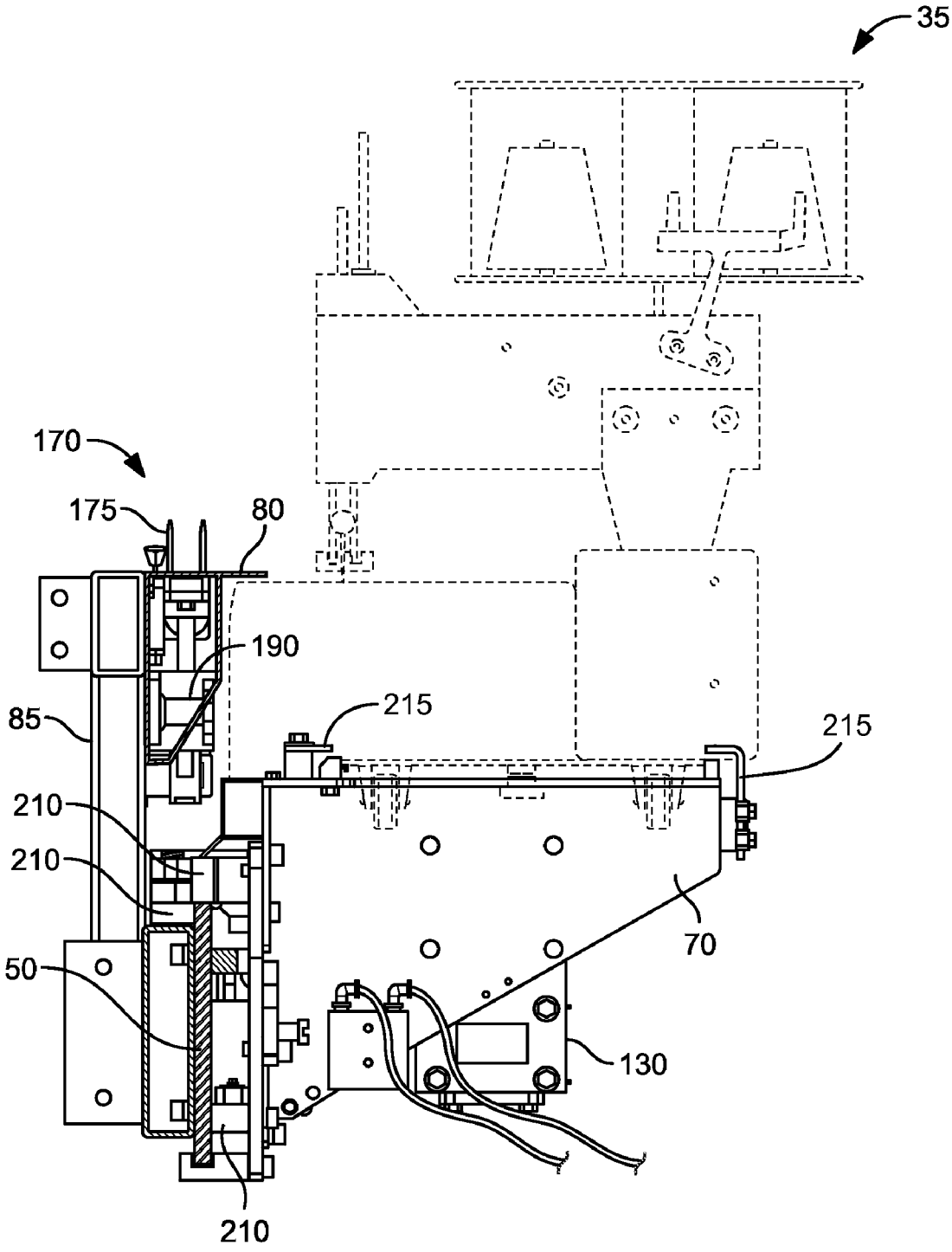
FIG. 7 is a side elevational view of the invention.

A substantially horizontal support platform 80 is fixed with the carriage rail 50 and adapted to hold each web 20 fixed with respect thereto, such that the sewing machine 35 can sew the webs 20 together as the sewing carriage 70 is moved from the proximal end 52 of the rail 50 to the distal end 58 thereof. Preferably the horizontal support platform 80 is fixed to the rearward side 59 of the carriage rail 50 with a plurality of rigid risers 85 (FIGS. 2 and 7). The support platform 80 preferably further includes at least two sets 170 of substantially vertical pins 175, each set 170 of pins 175 being selectively moveable with an actuator 180 between an extended position 188 (FIG. 4) projecting upward above the horizontal support platform 80, and a lowered position 182 (FIG. 2) below the horizontal support platform 80 and out of the way of the operator. The actuator 180 is preferably a pneumatic actuator 190 connected to an air valve 200 (FIG. 3) having at least an up position 208 and a down position 202, such that when the air valve 200 is positioned in its up position 208 the air valve 200 causes the pneumatic actuator 190 to raise each set 170 of pins 175 into its extended position 188. Alternately, when the air valve 200 is positioned in its down position 202, the air valve 200 causes the pneumatic actuator 190 to lower each et 170 of pins 175 into its retracted lowered position 182. Preferably an unlock signal means 240 connected with the actuator 180 and the spooling machine 30 is adapted to signal the actuator 180 to move the pins 175 into the lowered position 182 upon detection of an unlock signal received by the spooling means 30, or otherwise upon detection of movement of the spooling means 30. As such the pins 175 are prevented from being damaged by the movement of the webs 20 on the spooling means 30.

Each set 170 of pins 175 may further included an extended expanded position 178 (FIG. 4), where each set 170 of pins 175 is separated by a maximum distance $D_{max}$, and an extended collapsed position 177 (FIG. 5), where each set 170 of pins 175 is separated by a minimum distance $D_{min}$, with $D_{max}$ being less than $D_{min}$. As such, with each pin 175 fixed through the webs 20, the actuator 180 may be actuated to expand the distance between each set 170 of pins 175, thereby fixing the webs 20 on the pins 175.

Preferably the sewing system 10 further includes a return means 220 (FIG. 5) proximate the distal end 58 of the carriage rail 50 that causes the drive means 100 of the sewing carriage 70 to reverse upon reaching the return means 220. Further, a stop means 230 is fixed proximate the proximal end 52 of the carriage rail 50 that causes the drive means 100 of the sewing carriage 70 to stop upon reaching the stop means 230. Such a return means 220 and stop means 230 may be a reflective marker detectable by a light sensitive detector (not shown) of the sewing carriage 70 and cooperative with the drive means 100, or a protrusion adapted to actuate a contact switch (not shown) of the sewing carriage 70 and cooperative with the drive means 100.

The sewing machine 35, trimming machine 40, and drive means 100 are all preferably pneumatically powered. Air hoses and conduits may be included on the rearward side 59 of the carriage rail 50 provided same do not interfere with the free travel of either the sewing carriage 70 or the trimming carriage 150. The air hoses (for clarity, not enumerated or always illustrated) may be coiled to allow expansion and contraction thereof, as is known in the art. Typically such an air hose is suspended between an air distribution conduit and the machine 35, 40, 100 to which it is connected.

While a particular form of the invention has been illustrated and described, it will be apparent that various modifications can be made without departing from the spirit and scope of the invention. For example, the carriage rail 50 is illustrated as a rectangle in cross section, but a square, I-beam, or other shape of carriage rail 50 may be used. Accordingly, it is not intended that the invention be limited, except as by the appended claims.

The teachings provided herein can be applied to other systems, not necessarily the system described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

These and other changes can be made to the invention in light of the above Detailed Description. While the above description details certain embodiments of the invention and describes the best mode contemplated, no matter how detailed the above appears in text, the invention can be practiced in many ways. Details of the system may vary considerably in its implementation details, while still being encompassed by the invention disclosed herein.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

In general, the terms used in the following claims should not be construed to limit the is invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

While certain aspects of the invention are presented below in certain claim forms, the inventor contemplates the various aspects of the invention in any number of claim forms.

Accordingly, the inventor reserves the right to add additional claims after filing the application to pursue such additional claim forms for other aspects of the invention.

What is claimed is:

1. A sewing system for facilitating the sewing together with a sewing machine ends of at least two webs held by a spooling machine, the system comprising:

a substantially horizontal carriage rail having a proximal end, a distal end, a forward side, a rearward side, a top side, and a bottom side, the carriage rail further including a support mounting means adapted to support the carriage rail in a substantially fixed relationship with the spooling machine;

a sewing carriage slidably supported on the carriage rail and adapted to hold the sewing machine thereon; and a substantially horizontal support platform fixed with the carriage rail and adapted to hold each web fixed with respect thereto such that the sewing machine can sew the webs together as the sewing carriage is moved from the proximal end of the carriage rail to the distal end thereof;

the carriage rail further including a linear rack gear fixed thereto and spanning substantially the length of the carriage rail from the distal end to the proximal end, the sewing carriage further including a pinion gear engaging the rack gear when the sewing carriage is supported on the carriage rail, such that rotating the pinion gear moves the sewing carriage on the carriage rail, the system further including a drive means for selectively rotating the pinion gear in either direction.

2. The sewing system of claim 1 wherein the support mounting means is at least one floor stand for supporting the sewing system on a ground surface proximate to the spooling machine.

3. The sewing system of claim 1 wherein the support mounting means is a rigid framework for supporting the sewing system on the spooling machine.

4. The sewing rail of claim 1 wherein the drive means is a longitudinal drive of the sewing machine, such that when the sewing machine is in operation to sew the webs together, the sewing carriage is moved from the proximal end to the distal end of the carriage rail thereby.

5. The sewing rail of claim 1 wherein the drive means is an electric motor controlled by a switch having at least forward, reverse, and stop positions.

6. The sewing rail of claim 1 wherein the drive means is a pneumatic motor controlled by an air valve having at least forward, reverse, and stop positions.

7. A sewing system for facilitating the sewing together with a sewing machine ends of at least two webs held by a spooling machine, the system comprising:

a substantially horizontal carriage rail having a proximal end, a distal end, a forward side, a rearward side, a top side, and a bottom side, the carriage rail further including a support mounting means adapted to support the carriage rail in a substantially fixed relationship with the spooling machine;

a sewing carriage slidably supported on the carriage rail and adapted to hold the sewing machine thereon; and a substantially horizontal support platform fixed with the carriage rail and adapted to hold each web fixed with respect thereto such that the sewing machine can sew the webs together as the sewing carriage is moved from the proximal end of the carriage rail to the distal end thereof;

a trimming carriage slidably supported on the carriage rail and adapted to support a trimming machine, whereby the trimming machine trims the ends of each web ahead of the sewing machine as the trimming and sewing carriages move from the proximal end of the carriage rail to the distal end of the carriage rail.

8. The sewing system of claim 7 wherein the trimming carriage is selectively mechanically fixed with the sewing carriage with a mechanical fastener.

9. The sewing system of claim 1 wherein the horizontal support platform is fixed with the rearward side of the carriage rail with a plurality of rigid risers.

10. A sewing system for facilitating the sewing together with a sewing machine ends of at least two webs held by a spooling machine, the system comprising:

a substantially horizontal carriage rail having a proximal end, a distal end, a forward side, a rearward side, a top side, and a bottom side, the carriage rail further including a support mounting means adapted to support the carriage rail in a substantially fixed relationship with the spooling machine;

a sewing carriage slidably supported on the carriage rail and adapted to hold the sewing machine thereon; and a substantially horizontal support platform fixed with the carriage rail and adapted to hold each web fixed with respect thereto such that the sewing machine can sew the webs together as the sewing carriage is moved from the proximal end of the carriage rail to the distal end thereof;

the support platform further includes including at least two sets of substantially vertical pins, each set of pins including at least one pin, each set of pins selectively moveable with an actuator between an extended position projecting upward above the horizontal support platform and a lowered position below the horizontal support platform.

11. The sewing system of claim 10 wherein the actuator is a pneumatic actuator connected to an air valve having at least an up and a down position, such that when the air valve is positioned in its up position the air valve causes the pneumatic actuator to raise each set of pins into its extended position, and when the air valve is positioned in its down position the air valve causes the pneumatic actuator to lower each set of pins into its lowered position.

12. The sewing system of claim 10 wherein each set of pins further includes an extended expanded position where each set of pins is separated by a maximum distance, and an extended collapsed position wherein each set of pins is separated by a minimum distance, the minimum distance being less than the maximum distance, such that with each pin fixed through the webs, the actuator may be actuated to expand the distance between each set of pins, thereby fixing the webs on the pins.

13. The sewing system of claim 11 wherein each set of pins further includes an extended expanded position where each set of pins is separated by a maximum distance, and an extended collapsed position wherein each set of pins is separated by a minimum distance, the minimum distance being less than the maximum distance, such that with each pin fixed through the webs, the actuator may be actuated to expand the distance between each set of pins, thereby fixing the webs on the pins.

14. The sewing system of claim 1 wherein the sewing carriage further includes rollers for supporting the sewing carriage on the carriage rail.

15. The sewing system of claim 7 wherein the trimming carriage further includes rollers for supporting the trimming carriage on the carriage rail.

16. The sewing system of claim 1 further including a return means proximate the distal end of the carriage rail that causes the drive means of the sewing carriage to reverse upon reaching the return means, and further including a stop means proximate the proximal end of the carriage rail that causes the drive means of the sewing carriage to stop upon reaching the stop means.

17. The sewing system of claim 10 further including an unlock signal means connected with the actuator to automatically move the pins into the lowered position when an unlock signal is received thereby, the unlock signal being provided by the spooling machine upon movement thereof.

* * * * *